US010555619B2

(12) United States Patent
Chou

(10) Patent No.: US 10,555,619 B2
(45) Date of Patent: Feb. 11, 2020

(54) METHOD AND SYSTEM FOR ASSEMBLED FURNITURE

(71) Applicant: Yuntek International Inc., Hayward, CA (US)

(72) Inventor: David Chou, Hayward, CA (US)

(73) Assignee: Yuntek International Inc., Hayward, CA (US)

( * ) Notice: Subject to any disclaimer, the term of this patent is extended or adjusted under 35 U.S.C. 154(b) by 0 days.

(21) Appl. No.: 16/045,194

(22) Filed: Jul. 25, 2018

(65) Prior Publication Data

US 2019/0014917 A1 Jan. 17, 2019

Related U.S. Application Data

(62) Division of application No. 14/715,344, filed on May 18, 2015, now Pat. No. 10,058,191.

(30) Foreign Application Priority Data

Nov. 4, 2014 (CN) ..... 2014 2 0649977 U
Feb. 11, 2015 (CN) ..... 2015 2 0097038 U

(51) Int. Cl.
*A47C 17/02* (2006.01)
*A47C 31/11* (2006.01)
*A47C 4/52* (2006.01)

(52) U.S. Cl.
CPC ..... *A47C 31/11* (2013.01); *A47C 4/52* (2013.01); *A47C 17/02* (2013.01)

(58) Field of Classification Search
CPC ..... A47C 31/11; Y10T 29/48; Y10T 29/481
See application file for complete search history.

(56) References Cited

U.S. PATENT DOCUMENTS 3,788,700 A 1/1974 Wartes
4,712,837 A 12/1987 Swilley
(Continued)

FOREIGN PATENT DOCUMENTS

DE 102005010 707 A1 5/2006
WO WO2014/015440 A1 1/2014

OTHER PUBLICATIONS

U.S. Appl. No. 14/715,344, "Notice of Allowance", dated Apr. 27, 2018, 9 pages.
(Continued)

*Primary Examiner* — Jason L Vaughan
*Assistant Examiner* — Amanda Kreiling
(74) *Attorney, Agent, or Firm* — Kilpatrick Townsend & Stockton LLP

(57) ABSTRACT

Apparatuses and methods are disclosed for an assembled furniture. The assembled furniture includes a cover having a plurality of inner compartments and a plurality of dividers. The assembled furniture also includes a plurality of cushions disposed within respective inner compartments of the cover, where the plurality of cushions are confined in the inner compartments by the plurality of dividers. The plurality of inner compartments may include a back inner compartment, a left arm inner compartment, a right arm inner compartment, and a bottom seat compartment. The left arm inner compartment may be adjacent to an end of the back inner compartment. The right arm inner compartment may be adjacent to an opposite end of the back inner compartment. The bottom seat compartment may be disposed below at least the back, left arm, and right arm inner compartments. The assembled furniture is easily compressible and highly transportable.

15 Claims, 9 Drawing Sheets

(56) References Cited

U.S. PATENT DOCUMENTS

| | | | | |
|---|---|---|---|---|
| 5,102,191 | A | 4/1992 | Peng | |
| 7,017,996 | B2 | 3/2006 | Peterson | |
| 8,245,339 | B2 | 8/2012 | Murray et al. | |
| 8,668,271 | B2 | 3/2014 | Genesin et al. | |
| 2003/0066268 | A1 | 4/2003 | George | |
| 2007/0052276 | A1* | 3/2007 | Hurvich | A47C 13/005 297/440.14 |
| 2007/0056486 | A1 | 3/2007 | Cook | |
| 2008/0313814 | A1 | 12/2008 | Cheng | |

OTHER PUBLICATIONS

U.S. Appl. No. 14/715,344, "Final Office Action", dated Jan. 12, 2018, 6 pages.
U.S. Appl. No. 14/715,344, "Non-Final Office Action", dated Jun. 28, 2018, 6 pages.
U.S. Appl. No. 14/715,344, "Restriction Requirement", dated Apr. 3, 2017, 7 pages.

* cited by examiner

METHOD AND SYSTEM FOR ASSEMBLED FURNITURE

CROSS-REFERENCES TO RELATED APPLICATIONS

This application is a divisional of U.S. patent application Ser. No. 14/715,344, filed May 18, 2015, which claims priority to Chinese Patent Application No. 201420649977.1, filed Nov. 4, 2014 and Chinese Patent Application No. 201520097038.5, filed Feb. 11, 2015. Each of these applications is hereby incorporated by reference in its entirety for all purposes.

BACKGROUND OF THE INVENTION

The present disclosure relates in general to furniture, and in particular to assembled sofas for personal residences and commercial buildings.

Furniture is almost always found in buildings frequented by people, such as households and office buildings. Furniture helps people utilize the interior of a building for specific purposes. For instance, a table can be used for eating a meal, a bookshelf can be used for storing books, or a sofa can be used for resting. Sofas are typically designed to be soft yet supportive so that people may comfortably sit on them without collapsing the sofa. Industry leaders are constantly developing ways to distinguish their products from their competitors.

SUMMARY OF THE INVENTION

Embodiments of the present invention are directed to methods and systems for an assembled sofa. In an embodiment, the sofa includes a cover having inner compartments and a plurality of dividers. Cushions are confined in the inner compartments by the plurality of dividers. The plurality of dividers hold the cushions in the inner compartments such that the cushions erect and maintain the structure of the assembled sofa.

In an embodiment, an assembled furniture includes a cover including a plurality of inner compartments and a plurality of dividers and a plurality of cushions disposed within respective inner compartments of the cover, where the plurality of cushions are confined in the inner compartments by the plurality of dividers.

The plurality of inner compartments may include a back inner compartment, a left arm inner compartment adjacent to an end of the back inner compartment, a right arm inner compartment adjacent to an opposite end of the back inner compartment, and a bottom seat compartment disposed below at least the back inner compartment, left arm inner compartment, and the right arm inner compartment. In embodiments, the plurality of cushions fill the plurality of inner compartments to form the assembled furniture including a backrest, a right armrest, a left armrest, and a base. The bottom seat compartment may be adjacent to the back inner compartment, left arm inner compartment, and the right arm inner compartment.

The divider may be directly attached to the cover. In embodiments, the divider is formed of two flaps having complementary attachment mechanisms. The complementary attachment mechanisms may be complementary parts of a Velcro attachment mechanism. Additionally, in embodiments, the divider may be formed of one flap that has one end that is permanently attached to the cover, and another end that has a detachable attachment mechanism to attach to the cover. The divider may be coplanar with at least a portion of the cover. The plurality of dividers may confine the plurality of cushions to their respective inner compartments.

In embodiments, each cushion of the plurality of cushions include an outer skin and filling. The outer skin may include a perforated region, wherein the perforated region is more perforated than other regions of the outer skin. The filling may include a plurality of foam blocks.

In embodiments, a method of forming a packaged assembled furniture includes forming a cover containing a plurality of inner compartments and a plurality of dividers, forming a plurality of cushions, the plurality of cushions designed to fit inside the plurality of inner compartments, sealing the plurality of cushions in an air-tight bag, and removing the air from inside the air-tight bag to decrease the size of the plurality of cushions.

Removing the air from inside the air-tight bag may include vacuuming the air through an outlet valve in the air-tight bag with a vacuuming device. Forming the plurality of cushions may include blowing air and filling material into an inner cavity of an outer skin until additional filling material can no longer fit in the inner cavity.

In embodiments, a method of forming a cushion for an assembled furniture includes providing an outer skin having a perforated region, the outer skin having a sealable opening to an inner cavity, and blowing air and filling material into the inner region through the sealable opening, wherein the perforated region separates the air from the filling material by allowing air to exit out of the inner cavity but preventing the filling from exiting out of the inner cavity.

The inner region may be filled until filling material can no longer fit into the inner cavity. The filling material may include foam material. The perforated region may be more permeable than the non-perforated region.

Numerous benefits are achieved by way of these apparatuses over conventional apparatuses. Benefits provided by the present invention include a sofa that is highly portable. The cushions can be removed from the cover and vacuum packed to minimize the footprint of the sofa during transportation. Additionally, the confined cushions provide sufficient structural support so that a rigid frame is not required for structural support. These and other details of embodiments along with many of their advantages and features are described in the following description, claims, and figures.

DETAILED DESCRIPTION OF SPECIFIC EMBODIMENTS

In the following description, numerous examples and details are set forth in order to provide an understanding of embodiments of the present invention. It will be evident to one skilled in the art, however, that certain embodiments can be practiced without some of these details, or can be practiced with modifications or equivalents thereof.

Typically, sofas are constructed using a rigid frame and a plurality of cushions. The frame is designed to maintain the structural integrity of the sofa when the sofa is being used, and the plurality of cushions are placed on the frame to provide comfort during use. Although using the frame ensures that the sofa is structurally sound, the frame makes it difficult to transport. Additionally, the size of the frame may increase the weight of the sofa and impede the portability of the sofa. In light of these difficulties, industry leaders have created different types of sofas to address these problems. For instance, air sofas and bean bags have been created. Air sofas are sofas that are formed of an inflatable, non-permeable shell that maintains its structural integrity with air pressure. Bean bags are sofas that are formed of a fillable shell that maintains its structural rigidity with filler material, such as a large number of small compressible beads. These types of sofas utilize complex and durable seals to minimize leakage. However, inevitable leakage of air or beads requires constant re-filling.

Embodiments of the present invention provide systems and methods for an assembled sofa that maintains its structural integrity without the use of a rigid frame or the need for constant re-filling. The assembled sofa includes a breathable cover having a plurality of inner compartments and a plurality of dividers. The dividers confine a plurality of cushions within the inner compartments. The cushions may be formed of a breathable skin filled with small expandable foam blocks. When confined to respective inner compartments, the cushions erect and structurally support the assembled sofa. According to embodiments of the present invention, the assembled sofa does not require use of a rigid frame to form the assembled sofa, nor does it require a complex and durable seal to prevent leakage of filler material. Additionally, the assembled sofa can be disassembled and shrunk for ease of transportation. Although embodiments disclosed herein relate to sofas, any suitable furniture upon which people may sit or rest, such as, but not limited to, couches, love seats, and lounge chairs, are envisioned herein.

Figure 1:
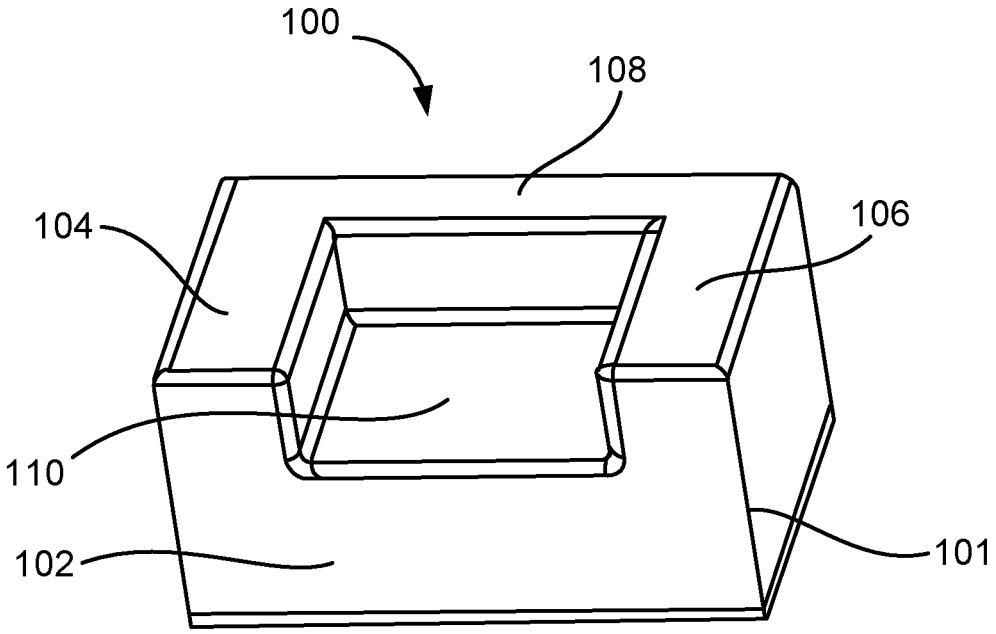
FIG. 1 is a simplified diagram illustrating an assembled furniture, according to embodiments of the present invention.

FIG. 1 illustrates an assembled furniture 100 according to an embodiment of the present invention. As shown, the assembled furniture 100 may be a comfortable seat, such as an assembled soft sofa. The assembled furniture 100 has a base 102, which provides a seat 110 upon which a person may sit. A backrest 108 is positioned near an edge of the base 102 to provide support for a person's back. The assembled furniture 100 also includes two armrests: a right armrest 104, and a left armrest 106. The armrests 104 and 106 may be positioned at opposite ends of the backrest 108 to provide support for a person's arms. It is to be appreciated that the sharp corners of the assembled furniture 100 are purely illustrative, and that one skilled in the art will realize that the sharp corners may be rounded corners, beveled corners, and any other non-sharp corner.

According to an embodiment of the present invention, the assembled furniture 100 includes a breathable cover 101 and a plurality of cushions encased within the cover 101. The plurality of cushions may form the structural composition of the assembled furniture 100. Any suitable permeable material that is soft to the touch and difficult to tear may be used to form the breathable cover 101. For instance, the cover 101 may be formed of a woven fabric or a porous leather. In an embodiment, the cover 101 is formed of a material containing polyester and cotton.

Figure 2A:
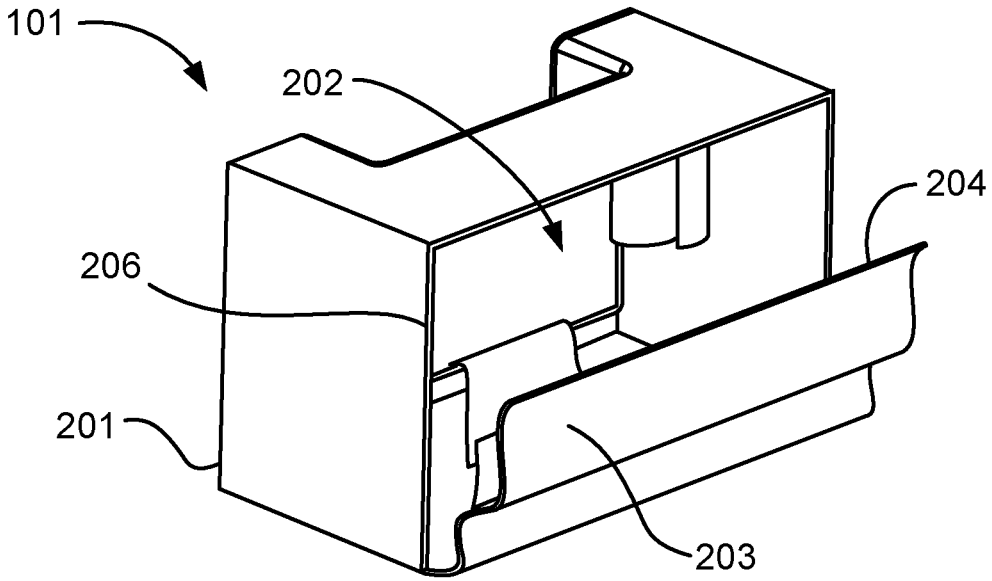
FIGS. 2A-2B are simplified diagrams illustrating an interior of a cover for an assembled furniture, according to embodiments of the present invention.
Figure 2B:
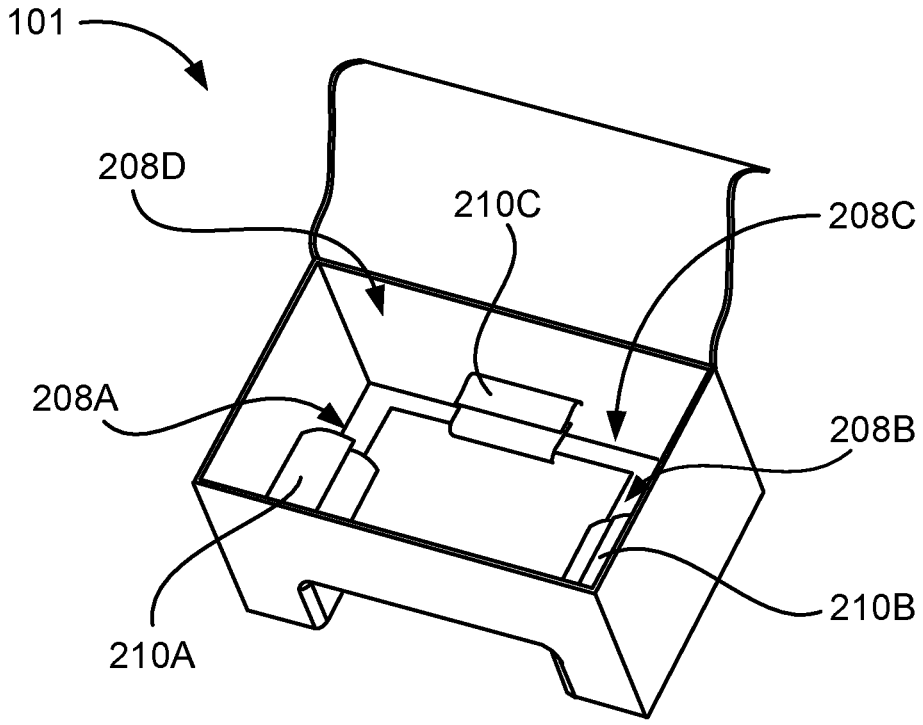

FIGS. 2A-2B illustrate different perspective views of the interior of the cover 101 according to embodiments of the present invention. As illustrated in FIG. 2A, the cover 101 includes a body 201. The body 201 may include a bottom flap 203 for opening and closing the cover 101. An attachment mechanism 204 on the bottom flap 203 may attach to a complementary attachment mechanism 206 to close the cover 101. The attachment mechanism 204 may attach to the complementary attachment mechanism 206 by any suitable non-permanent attachment method. For instance, mechanism 204 may attach to mechanism 206 by a Velcro attachment method. In such embodiments, the mechanisms 204 and 206 may be complementary Velcro attachments. In alternative instances, the mechanism 204 may attach to mechanism 206 by a zipper attachment method. In such embodiments, the mechanism 204 and 206 may be complementary zipper attachments. A cavity 202 within the cover 101 may include a plurality of inner compartments, as will be discussed herein with respect to FIG. 2B.

FIG. 2B illustrates a perspective view of the cover 101 that better shows the inner design of the cover 101 according to embodiments of the present invention. In embodiments, the cavity 202 includes a left arm inner compartment 208A, a right arm inner compartment 208B, a backrest inner compartment 208C, and a base inner compartment 208D. These inner compartments may be vacant spaces within the cover 101 that may be filled with respective cushions to form the assembled furniture 100. In an embodiment, the backrest inner compartment 208C and the left arm and right arm inner compartments 208A and 208B form a U-shaped cavity. In such an embodiment, the base inner cavity 208D may be located adjacent to the U-shaped cavity.

Portions of the U-shaped cavity may be separated from the base inner compartment 208D by a plurality of dividers 210. For instance, dividers 210 may separate the base inner compartment 208D from the backrest inner compartment 208C and the left arm and right arm inner compartments 208A and 208B. In embodiments, the dividers 210 are designed to confine cushions within the inner compartments 208A, 208B, and 208C to form the assembled furniture 100. The dividers 210 may be permanently attached to portions of the inner surface of the cover 101. Although FIG. 2B illustrates three separate dividers 210A, 210B, and 210C, embodiments having more or less dividers are envisioned herein. For instance, instead of having three dividers, one long divider may be used to separate the inner compartments according to embodiments discussed herein.

According to embodiments of the present invention, the dividers 210 may be a contraption that can engage and disengage to confine and release a cushion in a respective inner compartment. For instance, the dividers 210A, 210B, and 210C may be formed of two flaps that are capable of engaging with one another to confine cushions into inner compartments 208A, 208B, and 208C, respectively. The ends of the flaps may engage with one another by any suitable non-permanent attachment method. For instance, the ends of the dividers 210 may engage by a Velcro attachment method. Accordingly, each flap of a divider 210 may have one end that is permanently attached to the cover 101 and an opposite end that is not permanently attached to the other flap of the divider 210. Other suitable attachment methods include, but are not limited to, zipper attachment methods and buckle attachment methods. One skilled in the art understands that any suitable detachable attachment method may be used to engage the two flaps to one another. When the cushions are confined, the dividers 210 prevent the cushions from slipping out of the respective inner compartments. Embodiments disclosed herein are not limited to dividers 210 having two flaps. For instance, embodiments may have dividers 210 formed of more or less than two flaps. In an embodiment, the dividers 210 are formed of one flap is capable of confining a cushion according to embodiments disclosed herein. In such embodiments, the divider 210 may have one end that is permanently attached to the cover 101, and an opposite end that is not permanently attached to the cover 101. The non-permanent attachment may be formed by any suitable attachment method mentioned herein, such as by Velcro, zipper, or buckle attachment mechanisms.

Figure 3A:
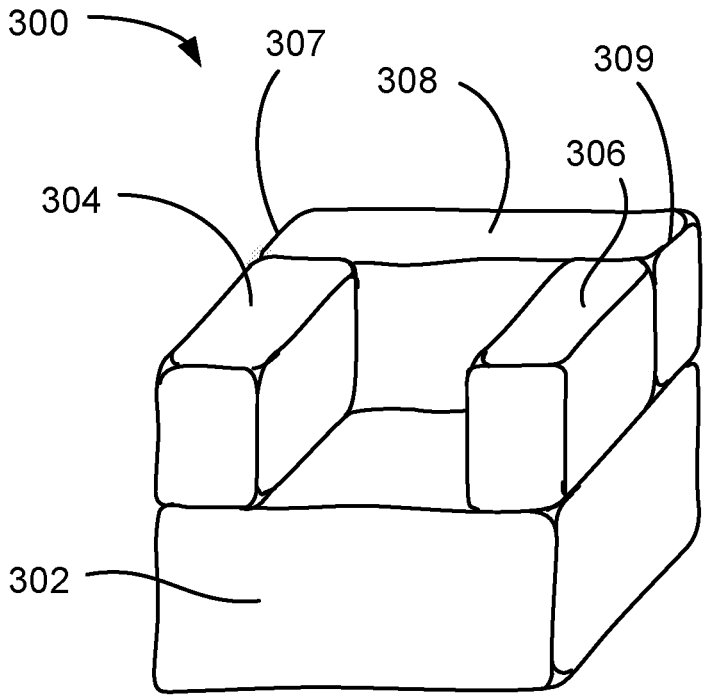
FIGS. 3A-3B are simplified diagrams illustrating cushion arrangements for an assembled furniture, according to embodiments of the present invention.
Figure 3B:
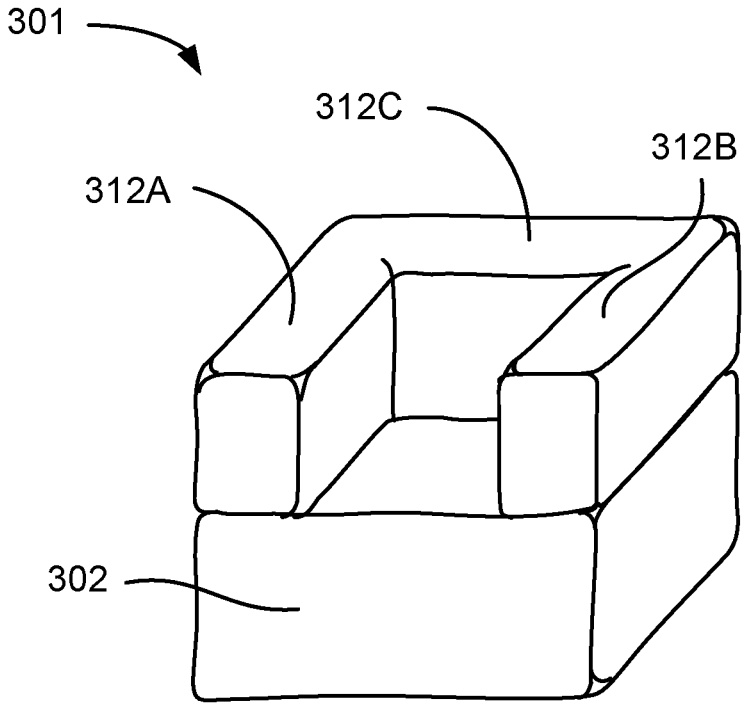

Arrangement of the cushions for an assembled furniture 100 are illustrated in FIGS. 3A-3B. The illustrations do not show the cover 101 to better illustrate how the cushions are arranged in the assembled furniture 100 by the cover 101.

FIG. 3A illustrates an arrangement 300 of cushions for the assembled furniture 100 according to an embodiment of the present invention. In the exemplary embodiment shown, the cushion arrangement 300 includes a right arm cushion 304, a left arm cushion 306, a backrest cushion 308, and a base cushion 302. The right and left arm cushions 304 and 306 may be disposed proximate to the ends 307 and 309 of the backrest cushion 308. In embodiments, the ends 307 and 309 are disposed on opposite ends of the backrest cushion 308. The backrest cushion 308 may be longer than the right and left arm cushions 304 and 306. The right and left arm cushions 304 and 306 may have substantially similar dimensions. In certain embodiments, the right and left arm cushions 304 and 306 and backrest cushion 308 are disposed on top of the base cushion 302. Accordingly, the base cushion 302 may support the cushions 304, 306, and 308. Although not shown, dividers 210 may confine the cushions 304, 306, and 308 to those respective positions on top of the base cushion 302.

Although the right arm cushion 304, left arm cushion 306, and backrest cushion 308 may be separate cushions, embodiments having different cushion arrangements are envisioned herein as well. For instance, FIG. 3B illustrates an alternative cushion arrangement 301 where one cushion is utilized to form more than one part of the assembled furniture. As shown, a single u-shaped cushion 312 may be used to form the right and left arm cushions 304 and 306 and backrest 308. Specifically, portions 312A and 312B may replace the right and left arm cushions 304 and 306, respectively. Portion 312C may replace the backrest portion 308. Utilizing one u-shaped cushion may increase the structural rigidity of the assembled furniture 100 because a single cushion may resist movement better than three separate cushions.

Figure 4A:
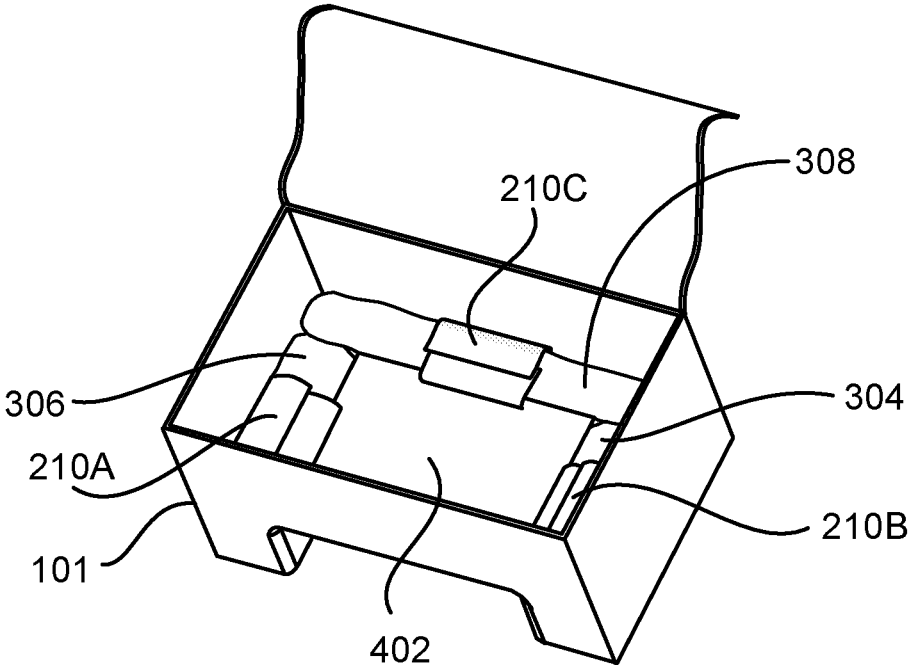
FIGS. 4A-4B are simplified diagrams illustrating a method of forming an assembled furniture, according to embodiments of the present invention.
Figure 4B:
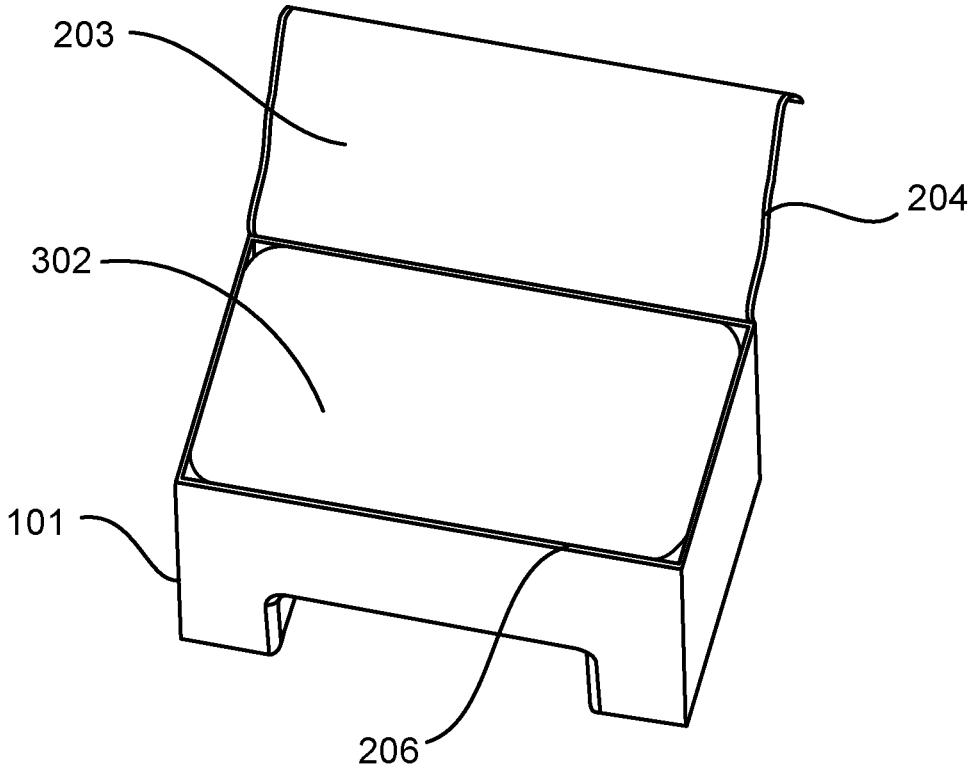

An exemplary method of forming the assembled furniture 100 is illustrated in FIGS. 4A-4B. As shown in FIG. 4A, the method includes inserting cushions into respective inner compartments. For instance, the backrest cushion 308 may be inserted into the backrest inner compartment 208C, and the right arm and left arm cushions 304 and 306 may be inserted into the right arm and left arm inner compartments 208A and 208B of FIG. 2, respectively. Any suitable insertion method may be utilized to insert the cushions into the inner compartments. For instance, the cushions may be pressed into the inner compartments by hand.

Once the cushions are in the inner compartments, the cushions may be confined in the inner compartments by the dividers 210. The dividers 210 may confine the cushions when the dividers 210 are engaged, for instance, by attaching the two flaps together with a Velcro attachment. In an embodiment, divider 210A confines the left arm cushion 306 into the left arm inner compartment 208A, divider 210 B confines the right arm cushion 304 into the right arm inner compartment 208B, and divider 210C confines the backrest cushion 308 into the backrest inner compartment 208C. The dividers 210 prevent the cushions from sliding out of the inner compartments. In an embodiment, the dividers 210 are substantially coplanar with a portion of the cover 101. For example, the dividers 210 may be substantially coplanar with an inner seat portion 402 of the cover 101.

Following insertion of the backrest, left arm, and right arm cushions, the base cushion 302 may be inserted into the base inner compartment 208D as illustrated in FIG. 4B. In an embodiment, the base cushion 302 is placed against the inner seat portion 402 and the dividers 210. After inserting the base cushion 302, the bottom flap 203 may be closed to enclose the cushions 302, 304, 306, and 308 in the cover 101, thereby completing formation of the assembled furniture 100. In an embodiment, the bottom flap 203 encloses the cushions by engaging the attachment mechanism 204 on the bottom flap 203 with the complementary attachment mechanism 206 on respective portions of the cover 101. For instance, the bottom flap 203 may be closed by a zipper or a Velcro attachment mechanism. In embodiments, the bottom flap 203 confines the base cushion 302 within the base inner compartment 208D.

According to embodiments of the present invention, the combination of the dividers 210, bottom flap 203, and the cushions 302, 304, 306, and 308 provide a structurally firm piece of furniture. The dividers 210 confine the cushions 304, 306, and 308 in place to erect the backrest 108 and right and left armrests 104 and 106. The confined cushions are stable enough to provide structural rigidity for the assembled furniture 100. In embodiments, a separate rigid frame, such as a wooden or metal frame, is not needed to erect and support the assembled furniture 100.

The plurality of cushions may be compressible, yet possess a degree of structural rigidity suitable to support the weight of a standard human being. For instance, the cushions may be stiff enough to support the weight of a person weighing approximately 150 pounds without completely compressing the cushion. A completely compressed cushion may be uncomfortable for a person to sit on. Details of the plurality of cushions are discussed herein with respect to FIG. 5.

Figure 5:
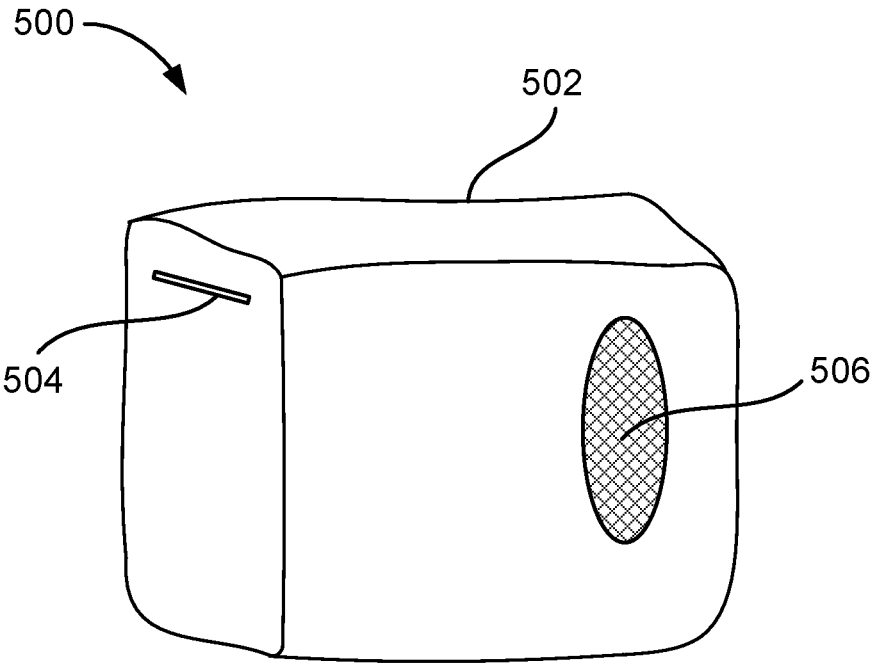
FIG. 5 is a simplified diagram illustrating a cushion for an assembled furniture, according to embodiments of the present invention.

FIG. 5 illustrates an exemplary cushion 500 according to embodiments of the present invention. The plurality of cushions 302, 304, 306, and 308 may be structurally similar to the cushion 500. Accordingly, the disclosures herein with respect to the cushion 500 apply to the plurality of cushions 302, 304, 306, and 308. In an embodiment, the cushion 500 is formed of a breathable outer skin 502 having a perforated region 506 and a sealed opening 504. The cushion 500 may be filled with any suitable filling material capable of enabling a cushion to have a degree of structural rigidity aforementioned herein. For instance, the cushion 500 may be filled with a plurality of expandable and compressible foam blocks. The foam blocks may be large enough to substantially reduce the probability of falling out of the skin 502. As an example, the foam blocks may be at least one cubic inch in volume.

The perforated region 506 may be disposed at any region of the outer skin 502. For instance, the perforated region 506 may be disposed near an end of the cushion opposite of the sealed opening 504. In embodiments, the perforated region 506 is more perforated than other regions of the breathable outer skin 502 such that air can more easily pass through the perforated region 506 than other regions of the outer skin 502. The sealed opening 504 may be a permanently sealed opening that was once opened, or a non-permanently sealed opening that can repeatedly open and close. In an embodiment, the sealed opening 504 is a non-permanently sealed opening that is sealed by a zipper attachment. The opening 504 allows a filling material to be placed in the outer skin 502, as discussed in the method of forming a cushion 500 illustrated in FIGS. 6A-6B.

Figure 6A:
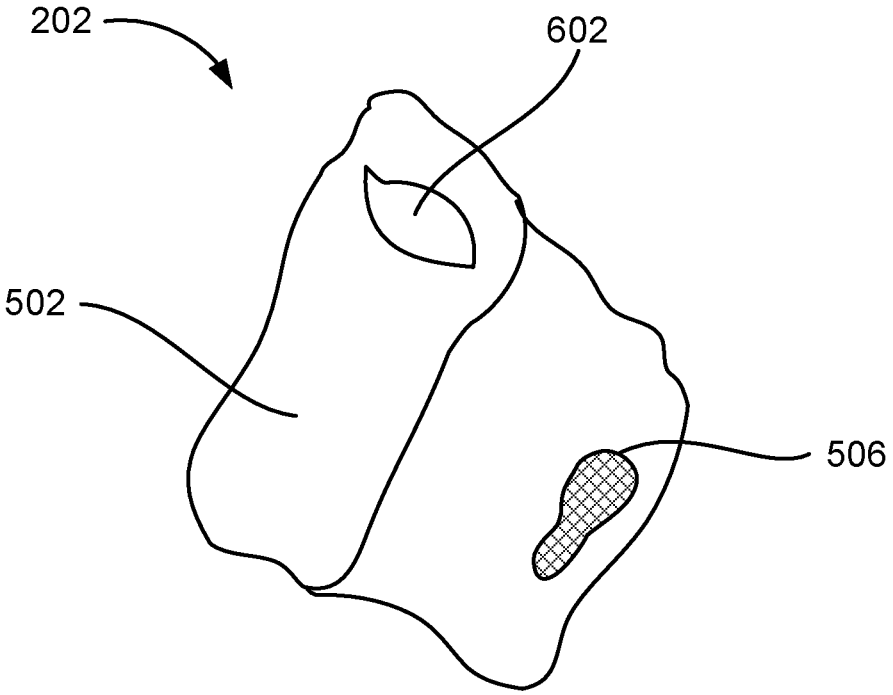
FIGS. 6A-6B are simplified diagrams illustrating a method of forming a cushion for an assembled furniture, according to embodiments of the present invention.
Figure 6B:
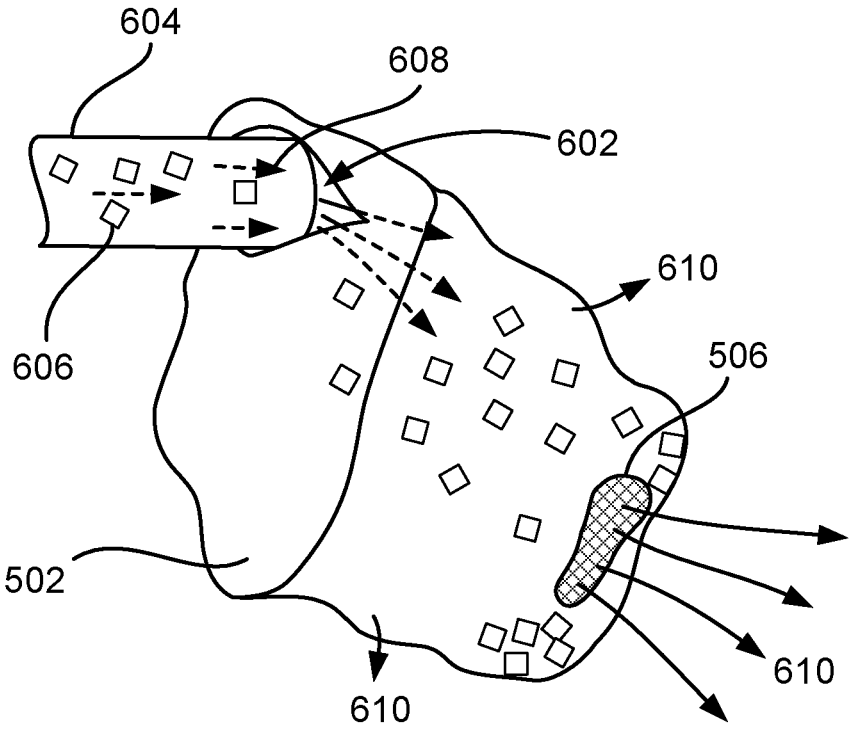

FIGS. 6A-6B illustrate a method of forming a cushion 500, such as cushions 302, 304, 306, and 308, according to embodiments of the present invention. In embodiments, the method includes providing the breathable outer skin layer 502. As shown in FIG. 6A, the outer skin layer 502 may be unfilled and have an opening 602, which may be the sealed opening 504 in an open state. Once the outer skin 502 is provided, the outer skin 502 may be filled with a filling material, as shown in FIG. 6B.

In an embodiment, a portion of a filling mechanism, such as a tube 604, is inserted into the opening 602. The tube 604 may be a part of a machine that can blow filling material out of the tube 604. In an embodiment, the machine uses air pressure to blow filling material 606 into the breathable skin 502. Because the filling material 606 is blown into the breathable skin 502, the tube 604 may also be delivering air 608 into the cover 502. As air 608 and filling material 606 enters into the skin 502, the skin 502 may trap the filling material 606 in the skin 502 and allow excess air 610 to escape. In embodiments, the perforated region 506 allows excess air to more easily escape out of the skin 502 than other regions of the skin 502. As excess air 610 continually escapes out of the skin 502, the filling material continually fills the inside of the skin 502. Due to the perforated region 506, the excess air 610 does not substantially exit out of the opening 602. Accordingly, filling material 606 does not blow out of the skin 502 during filling. The operation of the perforated region 506 is advantageous because it minimizes fill time and increases filling efficiency. Once the filling material 606 completely fills the breathable skin 502, the tube 604 is removed and the opening 602 is sealed, thereby completing the formation of the cushion 500.

Figure 7:
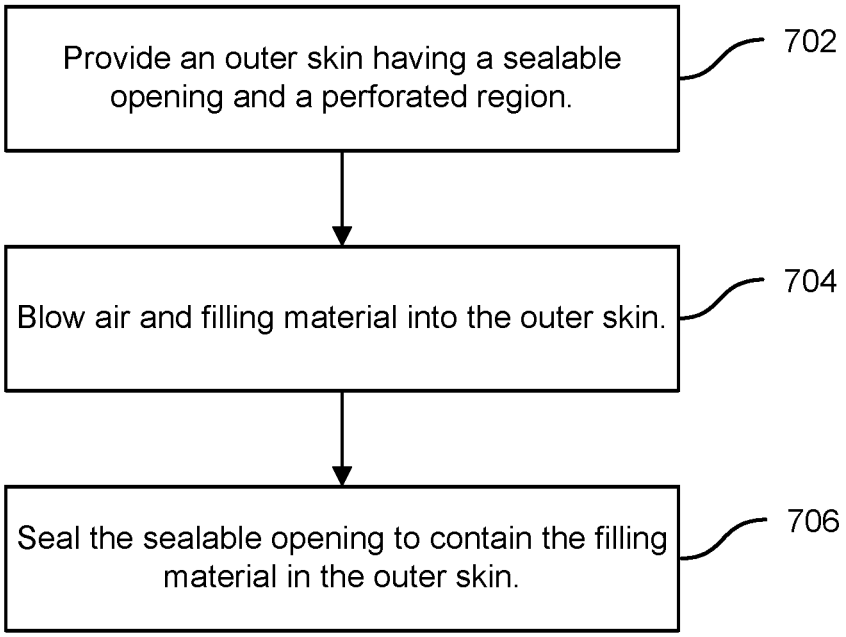
FIG. 7 is a flow chart illustrating the method of forming a cushion for an assembled furniture, according to embodiments of the present invention.

FIG. 7 is a flow chart illustrating the method of forming the cushion for the assembled furniture, according to embodiments of the present invention. At block 702, an outer skin having a sealable opening and a perforated region is provided. The outer skin may be the outer skin 502 as discussed herein with respect to FIG. 5. At block 704, the outer skin may be filled with filling material by blowing air and filling material into the outer skin. The filling material may be blown into the skin 502 through the sealable opening. At block 706, the sealable opening may be sealed to contain the filling material in the outer skin. In an embodiment, the sealable opening may be a zipper that can be sealed by pulling the zipper closed.

Having a breathable outer skin 502 enables the cushions 302, 304, 306, and 308 to be easily transportable. The breathable skin 502 allows the cushions to be shrunken in size prior to transportation, as shown in FIGS. 8A-8B.

Figure 8A:
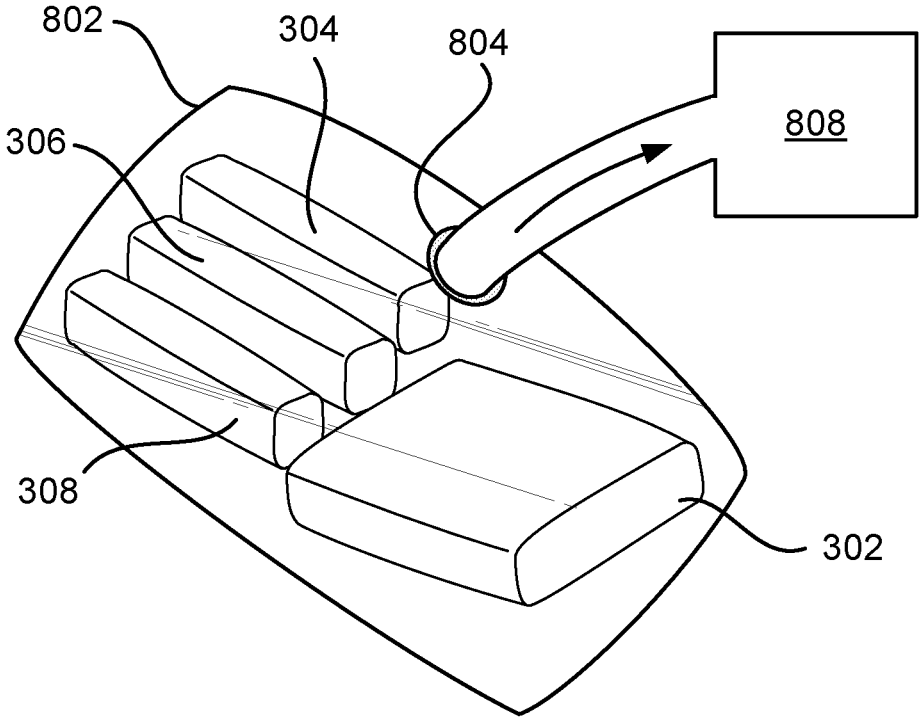
FIGS. 8A-8B are simplified diagrams illustrating a method of packaging an assembled furniture, according to embodiments of the present invention.
Figure 8B:
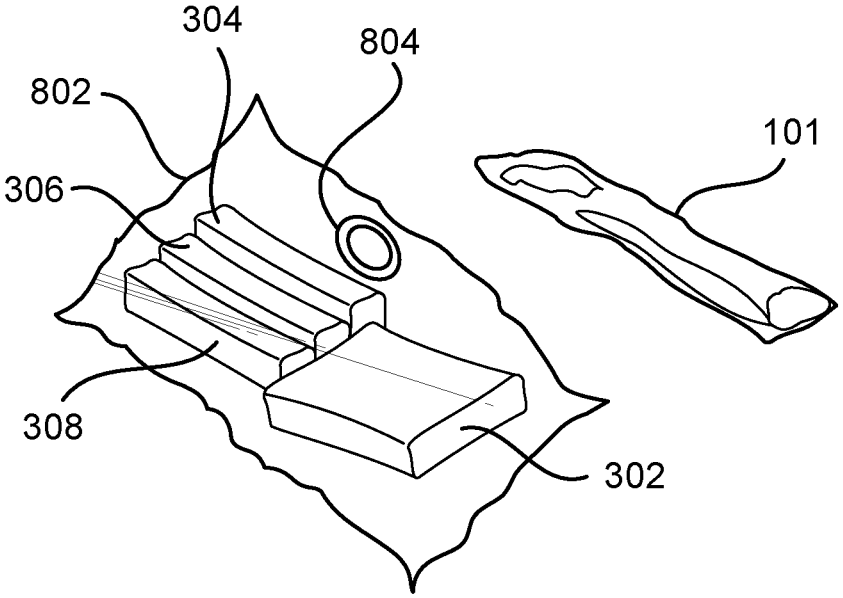

FIGS. 8A-8B illustrate a method of packaging the assembled furniture 100 for transportation, such as when the furniture is shipped to a customer by a manufacturer. In embodiments, the assembled furniture 100 may be disassembled for transportation. Disassembly may be performed by opening the bottom flap (e.g., bottom flap 203 in FIG. 2) and removing the cushions (e.g., cushions 302, 304, 306, and 308 in FIG. 3A) from the inside of the cover (e.g., cover 101 in FIG. 1).

As shown in FIG. 8A, the cushions 302, 304, 306, and 308 may be placed in an air-tight bag 802. The air-tight bag 802 may have a sealable opening that allows the cushions to be placed into the bag 802, and allows the bag 802 to be sealed to prevent air from unintentionally escaping from or entering into the bag 802. The air-tight bag 802 may include a valve 804 through which air inside the bag 802 may escape.

Once the cushions are placed in the bag 802, air may be sucked out of the bag 802 through the valve 804 by a vacuum 808, as illustrated in FIG. 8B. The vacuum 808 may be any suitable machine that is capable of removing air from inside the air-tight bag 802. As the air is removed from within the bag 802, the contents inside the bag 802 shrink into a form that has a smaller footprint than before the air was removed. The breathable skin of the cushions allows air to be removed from inside the skin, which enables the structure of the cushions to compress into a smaller structure. The valve 804 maintains the low pressure inside the bag 802 and prevents air from entering into the bag 802. In embodiments, the valve 804 may be a one-way valve that allows air to flow out of the bag but prevents air from entering into the bag.

In certain embodiments, the cover 101 may be left outside of the air-tight bag 802 because the cover 101 does not take up much volume when it is not filled with cushions. In other embodiments, the cover 101 may be disposed inside the bag 802 to keep all the components of the furniture together during transportation.

Figure 9:
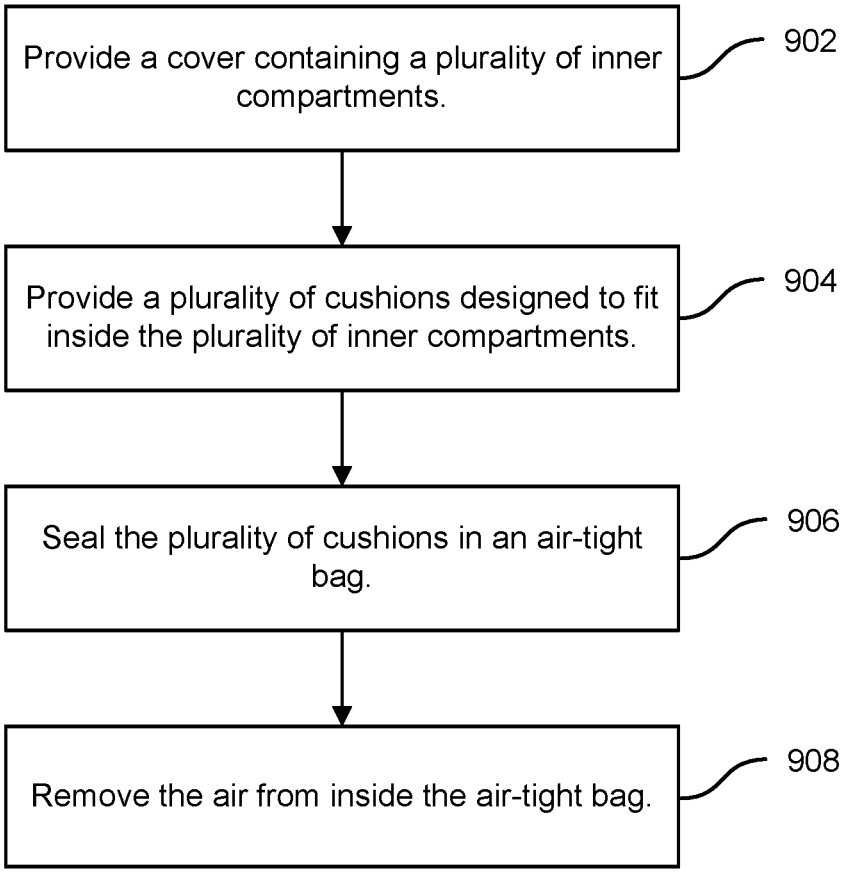
FIG. 9 is a flow chart illustrating the method of packaging an assembled furniture according to embodiments of the present invention.

FIG. 9 is a flow chart illustrating the method of packaging an assembled furniture according to embodiments of the present invention. At block 902, a cover containing a plurality of inner compartments is provided. The cover may be the cover 101 discussed herein with respect to FIG. 1. At block 904, a plurality of cushions designed to fit inside the plurality of inner compartments is provided. The plurality of cushions may be the cushions 302, 304, 306, and 308 discussed herein with respect to FIGS. 3A-3B. In an embodiment, the cover and/or the plurality of cushions are provided when the cushions are manufactured by a manufacturer, or purchased from a manufacturer. At block 906, the plurality of cushions may be sealed in an air-tight bag, such as the bag 802 discussed herein with respect to FIG. 8A-8B. Optionally, the cover may be sealed with the cushions in the air-tight bag. Once the cushions are sealed in the air-tight bag, at block 908, air disposed inside the bag may be removed through a valve by a vacuum machine. Accordingly, the size of the air-tight bag may be decreased as air is suctioned out. The smaller size enables easier shipment of the furniture, which increases ease of transportation and decreases transportation cost.

It should be appreciated that the specific steps illustrated in FIGS. 7 and 9 provide particular methods according to some embodiments. Other sequences of steps may also be performed according to alternative embodiments. For example, alternative embodiments may perform the steps outlined above in a different order. Moreover, the individual steps illustrated in FIGS. 7 and 9 may include multiple sub-steps that may be performed in various sequences. Furthermore, additional steps may be added or removed depending on the particular application.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. For example, although certain embodiments have been described with respect to particular process flows and steps, it should be apparent to those skilled in the art that the scope of the present invention is not strictly limited to the described flows and steps. Steps described as sequential may be executed in parallel, order of steps may be varied, and steps may be modified, combined, added, or omitted.

The specification and drawings are, accordingly, to be regarded in an illustrative rather than restrictive sense. Other arrangements, embodiments, implementations and equivalents will be evident to those skilled in the art and may be employed without departing from the spirit and scope of the invention as set forth in the following claims.

What is claimed is:

1. A method of forming a packaged assembled furniture comprising:

providing a single, contiguous cover defining a single cavity and comprising a plurality of dividers attached to the cover and disposed within the cavity, wherein the cavity is at least partially divided into a plurality of inner compartments by the plurality of dividers;

providing a plurality of cushions, the plurality of cushions configured to fit within respective inner compartments of the cavity, wherein the plurality of cushions are confined in the inner compartments by the plurality of dividers disposed within the respective inner compartments of the cavity;

sealing the plurality of cushions in an air-tight bag; and removing the air from inside the air-tight bag to decrease the size of the plurality of cushions.

2. The method of claim 1 wherein removing the air from inside the air-tight bag comprises vacuuming the air through an outlet valve in the air-tight bag with a vacuuming device.

3. The method of claim 1 wherein forming the plurality of cushions comprises blowing air and filling material into an inner cavity of an outer skin until additional filling material can no longer fit in the inner cavity.

4. The method of claim 1 wherein the plurality of inner compartments comprises:

a back inner compartment;

a left arm inner compartment adjacent to an end of the back inner compartment;

a right arm inner compartment adjacent to an opposite end of the back inner compartment; and a bottom seat compartment disposed below at least the back inner compartment, left arm inner compartment, and the right arm inner compartment.

5. The method of claim 1 wherein the plurality of cushions are configured to fill the plurality of inner compartments upon being disposed within the respective inner compartments of the cavity to form the assembled furniture comprising a backrest, a right armrest, a left armrest, and a base.

6. The method of claim 1 wherein the bottom seat compartment is adjacent to the back inner compartment, left arm inner compartment, and the right arm inner compartment.

7. The method of claim 1 wherein the divider is directly attached to the cover.

8. The method of claim 1 wherein the divider is formed of two flaps having complementary attachment mechanisms.

9. The method of claim 8 wherein the complementary attachment mechanisms are complementary parts of a Velcro attachment mechanism.

10. The method of claim 1 wherein the divider is formed of one flap that has one end that is permanently attached to the cover, and another end that has a detachable attachment mechanism to attach to the cover.

11. The method of claim 1 wherein the divider is coplanar with at least a portion of the cover.

12. The method of claim 1 wherein the plurality of dividers confine the plurality of cushions to their respective inner compartments.

13. The method of claim 1 wherein each cushion of the plurality of cushions comprise an outer skin and filling.

14. The method of claim 13 wherein the outer skin comprises a perforated region, wherein the perforated region is more perforated than other regions of the outer skin.

15. The method of claim 13 wherein the filling comprises a plurality of foam blocks.

* * * * *